US006190781B1

(12) United States Patent
Tsubaki et al.

(10) Patent No.: US 6,190,781 B1
(45) Date of Patent: Feb. 20, 2001

(54) SUPPORT FOR IMAGING MATERIAL

(75) Inventors: Masayuki Tsubaki; Touru Noda, both of Tokyo (JP)

(73) Assignee: Mitsubishi Paper Mills Limited, Tokyo (JP)

( * ) Notice: Under 35 U.S.C. 154(b), the term of this patent shall be extended for 0 days.

(21) Appl. No.: 09/233,096

(22) Filed: Jan. 19, 1999

(30) Foreign Application Priority Data

Jan. 20, 1998 (JP) ..... 10-008868
Jan. 8, 1999 (JP) ..... 11-002880

(51) Int. Cl.[7] ..... B41M 5/00

(52) U.S. Cl. ..... 428/513; 428/195; 428/211; 428/537.5

(58) Field of Search ..... 428/195, 211, 428/511–513

(56) References Cited

FOREIGN PATENT DOCUMENTS 58-68037 4/1983 (JP) .
58-95732 6/1983 (JP) .
60-69649 4/1985 (JP) .
63-173045 7/1988 (JP) .
63-307979 12/1988 (JP) .
6-230517 8/1994 (JP) .
6-266046 9/1994 (JP) .
7-36147 2/1995 (JP) .
7-120868 5/1995 (JP) .
7-168308 7/1995 (JP) .

*Primary Examiner*—Bruce H. Hess
(74) *Attorney, Agent, or Firm*—Pillsbury Winthrop LLP

(57) ABSTRACT

The task of the present invention is to provide an excellent resin-coated paper type support for imaging materials using a paper as a base which can provide imaging materials and prints made therefrom superior in visual gloss, cutting properties and curling properties. This task is attained by a support for imaging materials which comprises a paper mainly composed of natural pulp as a base, a resin layer (A) comprising a resin having film-formability coated on one side of the paper base on which an image forming layer is provided-and a resin layer (B) mainly composed of a polyethylene resin coated on another side of the paper base, wherein the natural pulp has a fiber length of 0.60 mm or less, the paper base has a density of 1.05 g/cm$^3$ or more, and the resin layer (B) mainly composed of a polyethylene resin is coated at 200 m/min or more.

15 Claims, No Drawings

SUPPORT FOR IMAGING MATERIAL

BACKGROUND OF THE INVENTION

The present invention relates to a resin-coated paper type support for imaging materials which comprises a paper mainly composed of natural pulp as a base, one side of the paper base (hereinafter sometimes referred to as "base paper") on which an image forming layer is provided being coated with a resin layer (A) containing a resin having film-formability and another side of the paper base being coated with a resin layer (B) mainly composed of a polyethylene resin. More particularly, it relates to a resin-coated paper type support for imaging materials which can provide imaging materials and prints obtained therefrom which are high in gloss appearance, especially, silver halide photographic papers and prints obtained therefrom (print of silver halide photographic paper is sometimes referred to as merely "photographic print" hereinafter), and is superior in cutting properties and curling properties.

Usually, an imaging material comprises a support for the imaging material and an image forming layer provided on the support. For example, silver halide photographic materials, ink jet recording materials, thermal diffusion transfer type thermal transfer recording image materials, heat-sensitive recording materials, and photosensitive-thermosensitive recording materials comprise a support for imaging materials and, coated thereon, an image forming layer such as a silver halide photographic layer, an ink imaging layer, heat-migration type heat transfer recording image layer, a heat-sensitive color forming layer, or a photosensitive heat-sensitive color forming layer, and, if necessary, auxiliary function layers such as a subbing layer, a protective layer and a back layer. Especially, the silver halide photographic layer comprises a silver halide photographic emulsion layer, a protective layer, a subbing layer, an intermediate layer, a color-mingling inhibition layer, an antihalation layer, a filter layer, an ultraviolet absorbing layer, a backing layer and combination thereof. For example, a single silver halide photographic material comprises a support for the photographic material and, provided thereon, a silver halide photographic emulsion layer and a protective layer therefor. Furthermore, a multi-layer silver halide color photographic material comprises a support for the photographic material and, provided thereon in succession, silver halide color photographic constituting layers such as a subbing layer, a blue-sensitive silver halide photographic emulsion layer and an intermediate layer, a green-sensitive silver halide photographic emulsion layer and an ultraviolet absorbing layer, a red-sensitive silver halide photographic emulsion layer and a protective layer.

Hitherto, there has been well known a resin-coated paper type support comprising a base paper coated with a resin having film-forming ability. As supports for silver halide photographic materials, for example, JP-B-55-12584 discloses a technique on supports for photographic materials comprising a base paper coated with a resin having film-forming ability, preferably a polyolefin resin. U.S. Pat. No. 3,501,298 discloses a support for photographic materials which comprises a base paper the both sides of which are coated with a polyolefin resin. Furthermore, since the rapid photographic development process has been applied to silver halide photographic materials, supports for photographic materials which comprise a base paper coated with a polyethylene resin on both sides have been practically used as supports for photographic papers, and, if necessary, the resin layer on the side on which an image forming layer is provided usually contains a titanium dioxide pigment to impart sharpness to images.

Moreover, U.S. Pat. No. 4,774,224 proposes a thermal transfer imaging element having as a support a resin-coated paper of 7.5 microinch-AA or less in surface roughness of the resin coat, particularly, a polyethylene resin-coated paper comprising a base paper coated with a polyethylene resin on the surface. In addition, JP-A-63-307979 discloses an ink jet recording sheet having a resin-coated paper as a support.

However, resin-coated paper type supports for imaging materials which comprise a base paper, especially, a base paper mainly composed of natural pulp which is coated with a resin layer on the side on which an image forming layer is provided still suffer from some serious problems and satisfactory results have not yet been obtained.

First, generally, a resin-coated paper used as a support for imaging materials which is coated with a resin layer containing at least a thermoplastic resin, especially a polyethylene resin on the side on which an image forming layer is provided (hereinafter, the side on which an image forming layer is provided is sometimes referred to as "top side", the resin layer coated on the top side is sometimes referred to as "top resin layer", the opposite side is sometimes referred to as "back side", and the resin layer coated on the back side is sometimes referred to as "back resin layer") is produced through a series of steps of casting a polyethylene resin composition in the form of a film on a running base paper from a slit die of a melt-extrusion machine to coat the composition on the base paper, press-bonding them between a press roll and a cooling roll, and peeling the resin-coated paper from the cooling roll. In the case of producing a resin-coated paper for imaging materials which is used for obtaining gloss, as the cooling roll there is used a cooling roll of very high smoothness which has a mirror surface, a glossy surface or a finely rough surface mentioned in JP-B-62-19732. Thus, since the top resin layer of the resin-coated paper in molten state is allowed to press-contact with the cooling roll of very high smoothness, this resin layer is processed to have a surface of high smoothness. As a result, imaging materials having said resin-coated paper as a support and prints obtained therefrom should have a visually high glossiness. However, imaging materials having the resin-coated paper as a support and prints obtained therefrom which were actually produced could not have sufficiently high gloss appearance. Especially, as for photographic papers having the resin-coated paper as a support, there could not be obtained photographic printing papers and photographic prints having sufficiently high gloss appearance.

Therefore, the inventors have made various investigations on the factors for the gloss appearance of imaging materials and prints obtained therefrom, and, as a result, it has been found that as the factors affecting the gloss appearance, there are various factors such as resin-coated paper as a support, image forming layer and image forming methods such as development, but the gloss appearance is also greatly affected by the resin-coated paper as a support. The inventors have made further investigations on the factor of the resin-coated paper affecting the gloss appearance, and as a result, it has been found that the gloss appearance of imaging materials and prints is governed by the factor of resin layer and besides by the factors of kind or properties of the base paper mainly composed of natural pulp, for example, kind and fiber length of natural pulp, stock slurry conditions such as additives for paper contained in stock slurry, paper making conditions such as paper making speed, smoothing press, machine calender conditions, after-treating conditions such as size press and tab size press, and, furthermore, surface roughness of the base paper, and other various factors. Moreover, it has been found that with the decrease in thickness of the top resin layer of the resin-coated paper, especially, in the case of 31 μm or less, the gloss appearance of imaging materials having the resin-coated paper as a support and prints obtained therefrom sharply decreases. Especially, photographic materials for glossy use are required to have a high gloss appearance for prints made from the photographic materials, and photographic materials which give photographic prints of inferior gloss appearance are utterly unsuitable for glossy use and have no commercial value.

Secondly, as for curling properties of imaging materials comprising a resin-coated paper type support and, coated thereon, an image forming layer and auxiliary function layers and those prints obtained from the imaging materials, the imaging materials and prints obtained therefrom preferably somewhat curl in minus (curling with the back side opposite to the image forming layer being inward) or are flat from the points of processability with processing devices in the production of prints from the imaging materials and appearance of the finished prints or pasting of the prints in albums. However, imaging materials having the conventional resin-coated paper as a support and prints obtained therefrom tend to greatly curl in plus (curling with the image forming layer side being inward) to cause problems in processability of the imaging materials, appearance of finished prints and pasting of the prints. The tendency of curling in plus of imaging materials having a resin-coated paper as a support and prints obtained from the imaging materials is mainly due to the contraction of binder contained mainly in the image forming layer and auxiliary function layers, and when gelatin is used as the binder, the tendency is conspicuous especially in silver halide photographic materials using gelatin as a main binder and photographic prints obtained therefrom, and it further became conspicuous especially under the environment of low humidity.

Thirdly, imaging materials comprising a base paper mainly composed of natural pulp which is coated with a resin layer mainly composed of a resin having film forming ability on the side on which an image forming layer is provided and is coated with a resin layer mainly composed of a polyethylene resin on the back side, and prints obtained after image forming treatment, especially, silver halide photographic materials and prints obtained after development treatment, mainly, prints in the form of roll, are cut to a desired size by cutters such as a guillotine cutter and a precision print cutter. In this case, there often occur the problems that the imaging materials or prints cannot be precisely cut and whiskers are formed at the cut surface to reduce commercial value and that they cannot be cut to the desired size. In the worst case, imaging materials and prints made therefrom, especially, silver halide photographic materials and prints thereof can hardly be cut and are bent. These phenomena are seen when photographic prints in the form of roll are cut at a high speed by a precision print cutter and especially when the distance between edges (hereinafter sometimes referred to as "edge width") is set wide.

Therefore, the inventors have made various investigations on the factors for the cutting properties of imaging materials and prints obtained therefrom, and, as a result, it has been found that as the factors affecting the cutting properties, there are various factors such as resin-coated paper as a support, image forming layer, kind of cutters and cutting conditions, and the cutting properties are greatly affected by the factors of the resin-coated paper as a support. The inventors have made further investigations on the factors of the resin-coated paper affecting the cutting properties, and as a result, it has been found that the cutting properties of imaging materials and prints are governed by the factors of resin layer and, besides, by the factors of kind or properties of the base paper mainly composed of natural pulp, for example, kind and fiber length of natural pulp, stock slurry conditions such as additives for paper contained in stock slurry, paper making conditions such as paper making speed, smoothing press, machine calender conditions, after-treating conditions such as size press and tab size press, and, furthermore, stiffness and density of the base paper, and other various factors. Moreover, it has been found that with the increase in thickness of the back resin layer of the resin-coated paper, especially, in the case of 20 μm or more, the cutting properties of imaging materials having the resin-coated paper as a support and prints obtained therefrom are conspicuously deteriorated.

Under the circumstances, when the method of increasing the thickness of the top resin layer which is the commonest and simplest method for improving the smoothness of the resin-coated paper is carried out for improving the gloss appearance of imaging materials and prints for the glossy use which is the first problem, with increase in thickness of the top resin layer, especially, in the case of 31 μm or more, the resin-coated paper, the imaging materials having the resin-coated paper as a support and prints curl with the image forming layer side being inside and, thus, there is caused the second problem of deterioration in curling properties.

Similarly, some technical proposals have been made to improve the gloss appearance. JP-A-61-132949 describes or discloses a technique to provide a photographic support of resin-coated paper type having a strong stiffness and a high glossiness by using a photographic base paper having a first coating layer mainly composed of a low-density polyethylene resin and a second coating layer composed of a polymer having a high stiffness modulus, and as the polymer having a high stiffness modulus, there are exemplified polyolefins such as polycarbonate (PC), high-density polyethylene (HDPE), polypropylene (PP), and linear low-density polyethylene (LLDPE), polyamides such as nylon 11, nylon 6, and nylon 66, and polyesters such as polyethylene terephthalate (PET) and polybutylene terephthalate (PBT). However, this technique is still insufficient for improving the gloss appearance of imaging materials using the resin-coated paper as a support and prints obtained therefrom, and, in addition, the second problem of deterioration in curling properties occurs. That is, when a polymer of high density is used as the polymer in the second coating layer, especially, with increase in density and with increase in content of the polymer in the layer, the resin-coated paper, the imaging materials having the resin-coated paper as a support and prints obtained from the imaging materials are deteriorated in curling properties.

JP-A-7-120868 discloses a technique on resin-coated paper type supports for photographic papers improved in adhesion between a base paper and a water-resistant resin layer and releasability from cooling roll by employing the water-resistant resin coating layer comprising two or more layers and by increasing the density of the layer remotest from the base paper than the density of the water-resistant resins of other layers, and JP-A-7-168308 discloses the attainment of the technique by employing the water-resistant resin coating layer comprising two or more layers and by using a water-resistant resin of a specific flexural modulus as the resin of the outermost layer. However, these techniques are still insufficient for improving the gloss appearance of imaging materials using the resin-coated paper as a support and prints obtained therefrom, and, in addition, the second problem of deterioration in curling properties occurs. That is, when a water-resistant resin of high density is used as the water-resistant resin in the coating layer, especially, with increase in density and with increase in content of the water-resistant resin in the coating layer, the resin-coated paper, the imaging materials having the resin-coated paper as a support and prints obtained from the imaging materials are deteriorated in curling properties.

On the other hand, for the purpose of improving the smoothness of resin-coated paper, JP-A-58-68037 discloses use of pulp having a specific fiber length distribution, JP-A-60-69649 discloses use of pulp having specific fiber length, width and thickness, JP-A-61-35442 discloses use of softwood pulp, JP-A-63-173045 discloses use of specific pulps such as low viscosity pulp, JP-A-58-37642 discloses use of a base paper having a Beck smoothness of higher than a specific value, JP-A-63-291054 discloses use of base papers having specific values of properties such as those having a surface roughness of lower than a specific value, JP-A-60-126397 discloses hot calender treatment of base paper, JP-A-61-284762 discloses employment of paper making method using a paper making machine having an upper dehydrating mechanism, JP-A-63-204250 discloses paper making by two-layer wire paper machine, and JP-A-64-20541 discloses use of specific paper making methods such as stretch press of wet paper. However, these are utterly insufficient for improving the gloss appearance of imaging materials using the resin-coated paper as a support and prints obtained therefrom.

In an attempt to improve the tendency of curling in plus direction of imaging materials and prints which is the second problem, it has often been conducted to contain a high-density polyethylene resin in a large amount in the back resin layer of the resin-coated paper used as a support or increase the thickness of the back resin layer. However, imaging materials using as a support the resin-coated paper containing a large amount of high-density polyethylene resin in the back resin layer or having a thick back resin layer suffer from the third problem of further deterioration in cutting properties.

In order to improve the cutting properties of resin-coated paper type supports, various proposals have been made. JP-A-55-98748 discloses a technique to improve cutting properties of resin-coated paper type photographic supports by using a base paper having a ratio of strengthening agent/sizing agent of 1.8 or more (based on absolute dry weight), preferably a base paper composed of a pulp having a specific nominal size specified in JIS P8207 and containing no long fibers. However, this technique is still insufficient to improve cutting properties of imaging materials having the support, and curling properties of the imaging materials are utterly unsatisfactory. Especially, when the high-density polyethylene resin is contained in an amount of more than 65% by weight in the back resin layer in an attempt to improve curling properties, cutting properties of the imaging materials are further deteriorated.

Furthermore, for the purpose of improving the cutting properties of resin-coated type photographic supports, some techniques on base papers have been proposed. JP-A-63-173045 discloses use of a base paper containing low viscosity pulp, JP-A-63-256788 discloses use of a base paper prepared using a pulp slurry beaten by a specific refiner disk, JP-A-63-306442 discloses use of a base paper composed of a pulp having a specific tensile strength, and JP-A-3-149542 discloses use of a base paper composed of a pulp having an average polymerization degree of 800 or more and an internal bonding power of 1.0–2.0 kgf·cm. However, these techniques are considerably insufficient to improve cutting properties of imaging materials having the support, and curling properties of the prints are utterly unsatisfactory.

On the other hand, for the purpose of improving the curling properties or the cutting properties of resin-coated paper type photographic supports, some techniques on back resin layer have been proposed. JP-B-48-9963 discloses a photographic support having good curling properties which comprises a base paper coated with a resin composition comprising a low-density polyethylene resin: a high-density polyethylene resin=1:1. Furthermore, JP-A-58-95732 discloses a photographic support of good cutting properties and curling properties which comprises a base paper coated with a polyethylene resin composition comprising 40–75 parts by weight of a high-density polyethylene resin having a density of 0.945 g/cm$^3$ or more and a melt index of 15–40 g/10 min and 60–25 parts by weight of a low-density polyethylene resin having a density of 0.930 g/cm$^3$ or less and a melt index of 1–40 g/10 min. Moreover, JP-A-6-230517, JP-A-6-266046 and JP-A-7-36147 disclose photographic supports of good cutting properties and curling properties and showing no formation of gel which comprises a base paper coated with a resin composition comprising a high-density polyethylene resin and a low-density polyethylene resin and having a critical shear rate of lower than a specific value.

However, cutting properties of imaging materials having as a support a resin-coated paper which comprises a base paper coated with a resin composition comprising a high-density polyethylene resin and a low-density polyethylene resin as disclosed in the above prior art are improved to some extent, but are still insufficient if the edge of precision print cutters wears out or the edge width is set somewhat wide (for example, when the edge width is set at 80 $\mu$m or more, especially 90 $\mu$m or more, further especially 100 $\mu$m or more), and, moreover, the cut size of the prints is not precise. Furthermore, cutting properties of imaging materials in which a resin-coated paper having a paper as a base is used as a support are considered to be determined upon entanglement of factors of base paper, resin layer and image forming layer, but these factors have not yet been clarified.

SUMMARY OF THE INVENTION

Accordingly, the object of the present invention is to provide a resin-coated paper type support for imaging materials which comprises a paper mainly composed of natural pulp as a base, one side of the paper base on which an image forming layer is provided being coated with a resin layer (A) containing a resin having film forming ability and another side of the paper base being coated with a resin layer (B) mainly composed of a polyethylene resin. Said resin-coated paper type support can provide imaging materials and prints which are high in gloss appearance, and good in curling properties and cutting properties.

As a result of intensive research conducted by the inventors in an attempt to solve the above problems, it has been found that the above object can be attained by a resin-coated paper type support for imaging materials which comprises a paper mainly composed of natural pulp as a base, one side of the paper base on which an image forming layer is provided being coated with a resin layer (A) containing a resin having film forming ability and another side of the paper base being coated with a resin layer (B) mainly composed of a polyethylene resin, characterized in that the natural pulp has a fiber length as specified below (a mere expression "fiber length of pulp" hereinafter means the fiber length of pulp as specified below) of 0.60 mm or less, the paper base has a density of 1.05 g/cm$^3$ or more, and the resin layer (B) mainly composed of a polyethylene resin is coated at 200 m/min or more.

Fiber length of pulp: A paper base of 4 cm×4 cm of a support for imaging materials is immersed in 80 cm$^3$ of a 1.0 N aqueous sodium hydroxide solution for 3 days and then sufficiently washed with water. Thereafter, water (pure water) is added to the paper base sufficiently washed with water so as to prepare a 3 wt % aqueous (pure water) slurry, followed by maceration by a dispersing apparatus not so as to cut the fibers to obtain a stock pulp slurry. Length-weighted average fiber length (mm) of the pulp is measured in accordance with JAPAN TAPPI Paper and Pulp Test Method No.52-89 "Paper and Pulp Fiber Length Test Method" and this is taken as the "fiber length of pulp" in the present invention.

With regard to the fiber length of pulp specified above, the maceration by a dispersing apparatus not so as to cut the fibers can be performed using any dispersing apparatuses as far as they can macerate the pulp fibers without cutting them, and specifically a juicer mixer the edge of which is rounded not so as to be able to cut the fibers can be employed. In this case, maceration can be performed by stirring for 20 minutes.

It has further been found that the object of the present invention can be efficiently attained when the fiber length of pulp is preferably 0.57 mm or less. It has further been found that the object of the present invention can be synergistically efficiently attained when density of the paper base is preferably 1.07 g/cm$^3$ or more, further preferably 1.09 g/cm$^3$ or more. In addition, it has been found that the object of the present invention can be synergistically more efficiently attained when the resin layer (B) mainly composed of a polyethylene resin is coated at 250 m/min or more, especially preferably 315 m/min or more. Thus, the present invention has been accomplished.

DETAILED DESCRIPTION OF THE INVENTION

The natural pulp constituting the base paper of the support for imaging materials used in the practice of the present invention has a fiber length of 0.60 mm or less, preferably 0.57 mm or less. If the fiber length of pulp is longer than 0.60 mm, the gloss appearance of the resulting imaging materials and prints is deteriorated or cutting properties are insufficient. The natural pulp having a fiber length within the above range can be prepared specifically by selecting a suitable pulp, beating the pulp by a beating machine of suitable construction under experimental conditions in a series of combination of beating conditions such as beating time, concentration of pulp, beating power and the like, making a base paper using the pulp and measuring the fiber length of pulp. As beating conditions of pulp, it is preferred to optimize the balance of cutting beating and wet beating, and the freeness of pulp after beating is preferably in the range of 200–400 ml, more preferably in the range of 240–380 ml, and especially preferably in the range of 280–360 ml.

As the natural pulp, there may be advantageously used wood pulps such as softwood pulp, hardwood pulp, and mixed pulp of softwood pulp and hardwood pulp which are subjected to usual bleaching treatments such as chlorine, hypochlorite and chlorine dioxide bleaching, and alkali extraction or alkali treatment, and, if necessary, oxidation bleaching with hydrogen peroxide or oxygen, or combination of these treatments. In addition, kraft pulp, sulfite pulp, soda pulp and, besides, regenerated pulp (waste paper pulp) and other various pulps can be used. Especially advantageous is hardwood bleached kraft pulp.

The base paper used in the present invention is preferably a natural pulp paper mainly composed of usual natural pulp. Further, the base paper may be a mixed paper mainly composed of natural pulp and containing synthetic pulp and synthetic fibers.

Density of the base paper of the support for imaging materials in the present invention is 1.05 g/cm$^3$ or more, preferably 1.07 g/cm$^3$ or more, more preferably 1.09 g/cm$^3$ or more. The adjustment of the density of the base paper to 1.05 g/cm$^3$ or more, preferably 1.07 g/cm$^3$ or more, more preferably 1.09 g/cm$^3$ or more can be attained by optimizing smoothing press and wet press in the paper making step, and especially by subjecting the resulting base paper to calendering treatment of at least two lines using machine calender, super calender, hot calender and the like under suitable conditions. If the density of base paper is less than 1.05 g/cm$^3$, particularly the gloss appearance of the resulting imaging materials and prints is inferior, and no excellent supports for imaging materials can be obtained.

Thickness of the base paper is not limited, but 40–250 $\mu$m is useful and 70–220 $\mu$m is preferred. If the thickness is too thin, imaging materials and prints are low in stiffness and become skinny and, furthermore, feeding becomes difficult and operability becomes inferior in image forming step, especially in developing step of photographic papers. If the thickness is too thick, curling state of the imaging materials in the form of roll remains as it is, resulting in deterioration of curling properties of the prints.

Various additives can be contained in the base paper mainly composed of natural pulp which are added at the time of preparation of stock slurry. For example, the following additives can be added in optional combination, namely, sizing agents such as metal salts of fatty acids and/or fatty acids, alkyl ketene dimer emulsification products and/or epoxidized higher fatty acid amides described or exemplified in JP-B-62-7534, alkenyl or alkylsuccinic acid anhydride emulsification products and rosin derivatives, dry strengthening agents such as anionic, cationic or amphoteric polyacrylamides, polyvinyl alcohol, cationized starch and vegetable galactomannan, wet strengthening agents such as polyaminepolyamide epichlorohydrin resin, fillers such as clay, kaolin, calcium carbonate and titanium oxide, fixers such as water-soluble aluminum salts, e.g., aluminum chloride and aluminum sulfate, pH adjustors such as sodium hydroxide, sodium carbonate and sulfuric acid, and coloring piments, coloring dyes and fluorescent brighteners as described or exemplified in JP-A-63-204251 and JP-A-1-266537.

Furthermore, a composition comprising various water-soluble polymers or hydrophilic colloid or latex, antistatic agents, and additives can be contained in or coated on the base paper mainly composed of natural pulp by size press, tab size press, blade coating, air knife coating or the like. The water-soluble polymers or hydrophilic colloids include starch polymers, polyvinyl alcohol polymers, gelatin polymers, polyacrylamide polymers, and cellulose polymers as described or exemplified in JP-A-1-266537; the emulsions and latexes include petroleum resin emulsions, emulsions or latexes of copolymers comprising at least ethylene and acrylic acid (methacrylic acid) as described or exemplified in JP-A-55-4027 and JP-A-1-180538, styrene-butadiene, styrene-acrylic acid or acrylate, vinyl acetate-acrylic acid or acrylate, emulsions or latexes of ethylene-vinyl acetate and butadiene-methyl methacrylate copolymers and carboxy-modified copolymers thereof; the antistatic agents include alkali metal salts such as sodium chloride and potassium chloride, alkaline earth metal salts such as calcium chloride and barium chloride, and organic antistatic agents such as colloidal metal oxides, e.g., colloidal silica, and polystyrenesulfonic acid salts; the pigments include clay, kaolin, calcium carbonate, talc, barium sulfate and titanium oxide; the pH adjustors include hydrochloric acid, phosphoric acid, citric acid and sodium hydroxide. In addition, above-mentioned additives such as coloring pigments, coloring dyes, and fluorescent brighteners can be advantageously contained in an suitable combination.

From the viewpoints of improving the gloss appearance of imaging materials and prints, the top side of the base paper used in the present invention preferably has a central plane average roughness SRa of 1.3 $\mu$m or less specified by the following formula 1 and measured at a cut-off value of 0.8 mm in paper making machine direction by a stylus-applied three-dimensional surface roughness tester.

$$SRa = \frac{1}{Sa}\int_0^{Wx}\int_0^{Wy}|f(x, y)|\,dx\,dy \quad (1)$$

In the above formula 1, Wx denotes length of the sample surface in the X-axis direction (paper making machine direction), Wy denotes length of the sample surface in the Y-axis direction (perpendicular to the paper making machine direction), and Sa denotes area of the sample surface.

Similarly, from the viewpoints of improving the gloss appearance of imaging materials and prints, the base paper used in the present invention preferably has a film thickness non-uniformity index Rpy of 250 mV or less in paper making machine direction as specified below. The film thickness non-uniformity index Rpy here is obtained in the following manner. A sample is run between two spherical feelers and is scanned by a film thickness measuring device which measures change of thickness of the sample as an electric signal through an electron micrometer at a constant speed of 1.5 m/min in paper making machine direction after zero point adjustment under the condition of ±15 $\mu$m/±3 V in sensitivity range of the electron micrometer, thereby to measure the change of thickness in the paper making machine direction. The thus obtained signal value is subjected to fast Fourier transform using Hanning window as a time window and using FFT analyzer. A power spectrum (unit: $mV^2$) is obtained by addition averaging of additions of 128 times, and the power values in the frequency region of 2–25 Hz are totaled. The resulting total value is multiplied by 2/3, followed by raising to 1/2th power. The thus obtained value (unit: mV) is the film thickness non-uniformity index Rpy.

The back resin layer (B) mainly composed of a polyethylene resin of the support for imaging materials of the present invention is coated at 200 m/min or more, preferably 250 m/min or more, more preferably 315 m/min or more. A support for imaging materials satisfying the object of the present invention can be obtained by providing the back resin layer (B) on the base paper in the manner as mentioned above. If the layer is coated at less than 200 m/min, the resulting imaging materials and prints are inferior especially in curling properties, and no excellent support for imaging materials can be obtained.

The back resin layer (B) mainly composed of a polyethylene resin is coated by so-called melt-extrusion coating method which comprises casting the resin in the form of film from a slit die of a melt-extrusion machine. Usually, a resin composition is coated by a series of steps of extruding and casting a molten resin composition in the form of film on a running base paper from a slit die of a melt-extrusion machine, press-bonding the coat and the base paper between a press roll and a cooling roll and peeling the coated base paper from the cooling roll. In this case, temperature of the molten film is preferably 280–340° C. The slit die is preferably a flat die such as T-die, L-die or fish-tail die, and the slit opening diameter is desirably 0.1–2 mm. Furthermore, the base paper is preferably subjected to activation treatments such as corona discharge treatment and flame treatment before coating with the resin composition. Moreover, as mentioned in JP-B-61-42254, an ozone-containing gas is blown to the molten resin composition on the side contacting with the base paper and, thereafter, the resin layer may be coated on a running base paper. If necessary, the back resin layer may be coated by a multi-layer extrusion coating method which provide a multi-layer structure of two or more layers. The back resin layer is preferably processed to have a dull surface.

As the polyethylene resin which is a main component of the back resin layer (B), there may be used various resins such as low-density polyethylene, medium-density polyethylene, high-density polyethylene, straight chain low-density polyethylene, copolymers with $\alpha$-olefins, e.g., ethylene and propylene, butylene, carboxy-modified polyethylene resins, and mixtures thereof. Those of various densities, MFR, molecular weights and molecular weight distributions can be used, but, generally, those having a density of 0.91–0.97 g/$cm^3$, an MFR of 1–30 g/10 min, and a molecular weight of 20,000–250,000 can be advantageously used each alone or in admixture of two or more. However, from the viewpoints of curling properties, cutting properties, mixability of resins, molding processability, and adhesion between the base paper and the resin layer, it is preferred to use a compound resin composition prepared by previously melting and mixing 90 –65 parts by weight of a high-density polyethylene resin having a melt flow rate of 10–40 g/10 min specified in JIS K6760 and a density of 0.960 g/$cm^3$ or more and 10–35 parts by weight of a low-density polyethylene resin or a medium-density polyethylene resin having a melt flow rate of 0.2–3 g/10 min specified in JIS K6760 and a density of 0.935 g/$cm^3$ or less. For preparing the compound resin by previous melting and mixing, simple melt mixing method, multi-stage melt mixing method or the like may be used. For example, a method can be advantageously employed according to which the resins are molten and mixed using an extruder, a twin-screw extruder, a hot roll mill, a Banbury mixer or a pressure kneader, if necessary, with addition of various additives such as an antioxidant, a lubricant and the like, and then the resulting mixture is pelletized.

The polyethylene resin which is a main component of the back resin layer (B) used in the present invention preferably has an infrared dichroic ratio (value D) of 0.70 or less as specified below. When the value D is 0.70 or less, synergistically the support for imaging materials can provide good curling properties for the resulting imaging materials and prints.

Infrared dichroic ratio (value D): The resin layer (B) coated, without a back layer, on the side of the base paper opposite to the side on which the image forming layer is provided is peeled from the base paper using an aqueous sodium hypochlorite solution, and an infrared absorption spectrum of this peeled film is measured by an infrared ray polarized by a polarizing plate. Of the two infrared absorption peaks at about 720 $cm^{-1}$ and about 730 $cm^{-1}$ which result from rocking vibration of $CH_2$ of polyethylene molecules, a peak intensity at about 720 $cm^{-1}$ is obtained. This peak intensity is a value of absorbance obtained using as a base line a line connecting a point of the smallest absorbance at 675–725 $cm^{-1}$ and a point of the smallest absorbance at 725–775 $cm^{-1}$. In this case, a peak intensity A(=) at about 720 $cm^{-1}$ of an infrared ray polarized in the direction parallel to the running direction (the longer direction) at melt-extrusion as a basic axis and a peak intensity A(+) at about 720 $cm^{-1}$ of an infrared ray polarized in the direction perpendicular to the running direction (the longer direction) at melt-extrusion as a basic axis are obtained. The ratio of A(=)/A(+) is the infrared dichroic ratio (value D).

The back resin layer (B) having a value D of 0.70 or less can be obtained by, for example, containing 70 parts by weight or more of a high-density polyethylene, containing 10 parts by weight or more of a low-density polyethylene or medium-density polyethylene which have a melt flow rate of 1 g/10 min or less specified in JIS K6760, using a compound resin composition prepared by previosuly melting and mixing resins, or an appropriate combination thereof, followed by extrusion processing.

The side of the base paper of the support for imaging materials on which an image forming layer is to be provided is coated with a resin layer (A) containing a resin having film formability. The resin having film formability is preferably a thermoplastic resin such as a polyolefin resin, a polycarbonate resin, a polyester resin, a polyamide resin or a mixture thereof. Among them, polyolefin resin is further preferred and polyethylene resin is especially preferred from the point of melt-extrusion coatability. Moreover, the base paper may be coated with a resin layer comprising an electron curable resin as described or exemplified in JP-B-60-17104.

As the polyethylene resin which is preferably used for the top resin layer, there may be used various resins such as low-density polyethylene, medium-density polyethylene, high-density polyethylene, straight chain low-density polyethylene, copolymers with α-olefins, e.g., ethylene and propylene or butylene, carboxy-modified polyethylene resins, and mixtures thereof. Those of various densities, MFR, molecular weights and molecular weight distributions can be used, but, generally, those having a density of 0.91–0.97 $g/cm^3$, an MFR of 1–30 g/10 min, and a molecular weight of 20,000–250,000 can be advantageously used each alone or in admixture of two or more.

In case the resin in the top resin layer is a thermoplastic resin, preferably a polyolefin resin, especially preferably a polyethylene resin, the top resin layer is coated by so-called melt-extrusion coating method as in the case of the back resin layer. In this case, if necessary, it may be coated by multi-layer melt-extrusion coating method, but it is preferred to coat the top resin layer by sequential extrusion molten resin coating method of two or more times. When the top resin layer is coated by the sequential extrusion molten resin coating method, synergistically the support for imaging materials can provide high gloss appearance for the resulting imaging materials and prints.

As in the case of the back resin layer, temperature of the molten film in melt-extrusion coating is preferably 280–340° C., and the slit die is preferably a flat die such as T-die, L-die or fish-tail die, and the slit opening diameter is desirably 0.1–2 mm. Furthermore, as in the case of the back resin layer, the base paper is preferably subjected to activation treatments such as corona discharge treatment and flame treatment before coating with the resin composition. Moreover, as mentioned in JP-B-61-42254, an ozone-containing gas is blown to the molten resin composition on the side contacting with the base paper and, thereafter, the resin layer may be coated on a running base paper. Furthermore, preferably the top and back resin layers are sequentially, preferably continuously extrusion coated on the base paper. The top resin layer may be processed to have a gloss surface, finely rough surface as mentioned in JP-B-62-19732, a matte surface or a silk-finish surface.

Thickness of the top and back resin layer of the support for imaging materials according to the present invention is not limited, but as the thickness of the top resin layer, 9–60 μm is useful, and 12–45 μm is preferred, and as the thickness of the back resin layer, 5–60 μm is useful, and 8–40 μm is preferred.

The top and back resin layers of the support for imaging materials can contain various additives in suitable combinations. Examples of the additives are white pigments such as titanium oxide, zinc oxide, talc and calcium carbonate, fatty acid amides such as stearic acid amide and arachidic acid amide, and fatty acid metallic salts such as zinc stearate, calcium stearate, aluminum stearate, magnesium stearate, zinc palmitate, zinc myristate and calcium palmitate which are disclosed in JP-B-60-3430, JP-B-63-11655, JP-B-1-38291, JP-B-1-38292, and JP-A-1-105245, antioxidants such as hindered phenols, hindered amines, phosphorus and sulfur type antioxidants which are disclosed in JP-A-1-105245, blue pigments and dyes such as cobalt blue, ultramaline, cerulean blue and phthalocyanine blue, magenta pigments and dyes such as cobalt violet, fast violet and manganese violet, and fluorescent brighteners and ultraviolet absorbers as disclosed in JP-A-2-254440. These additives are contained preferably as a master batch or a compound. Especially, for containing these additives in a compound resin composition for the back resin layer, they may be previously added to high-density polyethylene resin and low-density polyethylene resin or medium-density polyethylene resin or at the time of preparation of compound resin, or a master batch is previously prepared by adding the additives at high concentrations to the resin and this master batch may be added to the resin at the time of melt-extrusion coating.

A subbing layer as disclosed or exemplified in JP-A-61-84643, JP-A-1-92740, JP-A-1-102551 and JP-A-1-166035 can be provided on the surface of the top resin layer after subjected to activation treatments such as corona discharge treatment and flame treatment.

Various back layers for antistatic purpose and the like may be provided on the surface of the back resin layer after subjected to activation treatments such as corona discharge treatment and flame treatment. Furthermore, the back layer may contain, in suitable combinations, inorganic antistatic agents such as colloidal silica, colloidal alumina, hectorite clay colloid and mixtures thereof, binders and organic antistatic agents which are disclosed in JP-A-5-107688, carboxyl group- or sulfone group-containing water-soluble synthetic polymer compounds or salts thereof or hydrophilic synthetic polymer colloid materials or salts thereof which are disclosed in JP-A-59-214849 and which are used for both the purposes of binder and antistatic agent, polymer latexes disclosed or exemplified in JP-A-59-214849, starches which are disclosed or exemplified in JP-A-58-14131, polyvinyl pyrrolidones which are disclosed or exemplified in JP-A-58-45248, polyvinyl alcohol which is disclosed or exemplified in JP-A-62-220950, polymers such as chitosan which are disclosed or exemplified in JP-A-63-189859, curing agents which are disclosed or exemplified in JP-B-58-56859, and matting agents and surface active agents which are disclosed or exemplified in JP-A-59-21849.

Apparatuses used for coating the coating solution for the back layer include air knife coater, roll coater, bar coater, blade coater, slide hopper coater, gravure coater, flexogravure coater, and combinations thereof. As drying apparatuses for the coat, mention may be made of various drying apparatuses, e.g. hot air dryers such as linear tunnel dryer, arch dryer, air loop dryer, and sine curve dryer, infrared heating dryer, and dryers utilizing microwaves.

The support for imaging materials according to the present invention which is provided with various photographic constitution layers can be used for various uses such as color photographic papers, black and white photographic papers, phototypesetting photographic papers, copying photographic papers, reversal photographic materials, negatives and positives for silver salt diffusion transfer process and printing materials. For example, silver chloride, silver bromide, silver chlorobromide, silver iodobromide and silver chloroiodobromide emulsion layers can be provided. Multi-layer silver halide color photographic constituting layers can be provided with adding color couplers to silver halide photographic emulsion layers. Furthermore, photographic constituting layers for silver salt diffusion transfer process can be provided. As binders for these photographic constituting layers, hydrophilic polymers such as polyvinyl pyrrolidone, polyvinyl alcohol and sulfate esters of polysaccharides can be used in addition to the commonly used gelatin. Moreover, the above photographic constituting layers can contain various additives in suitable combinations. Examples of the additives are sensitizing dyes such as cyanine dyes and merocyanine dyes, chemical sensitizers such as water-soluble gold compounds and sulfur compounds, antifoggants and stabilizers such as hydroxytriazolopyrimidine and mercapto-heterocyclic compounds, hardeners such as formaldehyde, vinylsulfone compounds and aziridine compounds, coating aids such as alkylbenzenesulfonates and sulfosuccinates, stainproofing agents such as dialkylhydroquinone compounds, fluorescent brighteners, sharpness improving dyes, antistatic agents, pH adjustors, and fogging agents, and besides water-soluble iridium compounds and water-soluble rhodium compounds can be contained at the time of production and dispersion of silver halides.

The photographic materials according to the present invention can be subjected to treatments such as exposure, development, stopping, fixation, bleaching, and stabilization depending on the kinds of the photographic materials which are mentioned in Goro Miyamoto, "Photograpahic Photosensitive Materials and Handling thereof" (Photographic Technique Course 2, published from Kyoritsu Shuppan Co., Ltd.). The multi-layer silver halide color photographic materials can be treated with a developer containing a development accelerator such as benzyl alcohol, thallium salt or phenidone or can be treated with a developer containing substantially no benzyl alcohol.

The supports for imaging materials of the present invention which are provided with various heat transfer recording image receiving layers can be used as supports for various heat transfer recording image receiving materials. As synthetic resins used for these heat transfer recording image receiving layers, mention may be made of resins having an ester bond such as polyester resins, polyacrylate resins, polycarbonate resins, polyvinyl acetate resins, polyvinyl butyral resins, styrene acrylate resins, and vinyltoluene acrylate resins, resins having an urethane bond such as polyurethane resins, resins having an amide bond such as polyamide resins, resins having an urea bond such as urea resins, polycaprolactam resins, styrene resins, polyvinyl chloride resins, vinyl chloride-vinyl acetate copolymer resins, and polyacrylonitrile resins. In addition to these resins, there may also be used mixtures or copolymers thereof.

In addition to the above synthetic resins, releasing agents, pigments and the like may be added to the heat transfer recording image receiving layer according to the present invention. As the releasing agents, mention may be made of solid waxes such as polyethylene wax, amide wax and Teflon powder, fluorine-based and phosphate ester-based surface active agents, and silicone oil. Among them, silicone oil is most preferred. As the silicone oil, oily one can be used, but hardened type is preferred. The hardened type silicone oil includes those of reaction hardened type, light hardened type and catalyst hardened type, and the reaction hardened type is especially preferred. The reaction hardened type silicone oil includes amino-modified silicone oil, epoxy-modified silicone oil, or the like. Amount of the reaction hardened type silicone oil added is preferably 0.1–20 wt % in the image receiving layer. As the pigments, preferred are extender pigments such as silica, calcium carbonate, titanium oxide, and zinc oxide. Thickness of the image receiving layer is preferably 0.5–20 $\mu$m, more preferably 2–10 $\mu$m.

The support for imaging materials according to the present invention which is provided with various ink receiving layers can be used as a support for various ink jet recording materials. These ink receiving layers can contain various binders for the purpose of improving drying properties of ink and sharpness of images. As examples of the binders, mention may be made of various gelatins such as lime-treated gelatin, acid-treated gelatin, enzyme-treated gelatin and gelatin derivatives, e.g., gelatins reacted with anhydrides of dibasic acids such as phthalic acid, maleic acid and fumaric acid; synthetic polymers such as usual polyvinyl alcohols of various saponification degrees, carboxy-modified, cation-modified and amphoteric polyvinyl alcohols and derivatives thereof, starches, e.g., oxidized starch, cationized starch and etherified starch, cellulose derivatives, e.g., carboxymethylcellulose and hydroxyethylcellulose, polyvinyl pyrrolidone, polyvinylpyridium halides, sodium polyacrylate, salts of acrylic acid-methacrylic acid copolymer, polyethylene glycol, polypropylene glycol, polyvinyl ether, alkylvinyl ether-maleic anhydride copolymer and styrene-maleic anhydride copolymer and salts thereof, and polyethylene imine; conjugated diene copolymer latexes such as styrene-butadiene copolymer and methyl methacrylate-butadiene copolymer; vinyl acetate polymer latexes such as polyvinyl acetate, vinyl acetate-maleate ester copolymer, vinyl acetate-acrylate ester copolymer, and ethylene-vinyl acetate copolymer; latexes of acrylic polymers or copolymers such as acrylate ester polymer, methacrylate ester polymer, ethylene-acrylate ester copolymer, and styrene-acrylate ester copolymer; vinylidene chloride copolymer latexes; functional group-modified polymer latexes obtained by modifying these various polymers with monomers containing functional groups such as carboxyl group; aqueous adhesives such as thermosetting synthetic resins, e.g., melamine resin and urea resin; synthetic resin type adhesives such as polymethyl methacrylate, polyurethane resin, unsaturated polyester resin, vinyl chloride-vinyl acetate copolymer, polyvinyl butyral and alkyd resin; and inorganic binders such as alumina sol and silica sol which are disclosed or exemplified in JP-B-3-24906, JP-A-3-281383 and JP-A-4-240725. These binders can be contained each alone or in combination.

The ink receiving layer of the ink jet recording materials according to the present invention can contain various additives in addition to the binders. Examples of these additives are surface active agents such as anionic surface active agents, e.g., long chain alkylbenzene-sulfonates and long chain, preferably, branched alkysulfosuccinates, nonionic surface active agents, e.g., polyalkylene oxide ether of long chain, preferably branched alkyl group-containing phenol and polyalkylene oxide ether of long chain alkyl alcohol, and fluorinated surface active agents disclosed in JP-B-47-9303 and U.S. Pat. No. 3,589,906; silane coupling agents such as γ-aminopropyltriethoxysilane and N-β (aminoethyl)-γ-aminopropyltrimethoxysilane; hardeners for polymers such as active halogen compounds, vinylsulfone compounds, aziridine compounds, epoxy compounds, acryloyl compounds and isocyanate compounds; preservatives such as p-hydroxybenzoate ester compounds, benzoisothiazolone compounds and isothiazolone compounds which are disclosed or exemplified in JP-A-1-102551; coloring pigments, coloring dyes and fluorescent brighteners which are disclosed or exemplified in JP-A-63-204251 and JP-A-1-266537; yellowing inhibitors such as sodium hydroxymethanesulfonate and sodium p-toluenesulfinate; ultraviolet absorbers such as benzotriazole compounds having a hydroxy-di-alkylphenyl group on 2-position; antioxidants such as poly-hindered phenol compounds disclosed or exemplified in JP-A-1-105245; pencil writing agents such as organic or inorganic fine particles having a particle size of 0.2–5 μm, e.g., starch particles, barium sulfate and silicon dioxide, and organopolysiloxane compounds disclosed or exemplified in JP-B-4-1337; pH adjustors such as sodium hydroxide, sodium carbonate, sulfuric acid, hydrochloric acid, phosphoric acid and citric acid; and antifoamers such as octyl alcohol and silicon-based antifoamers. These can be contained in suitable combinations.

The present invention will be explained in more detail by the following examples.

EXAMPLE 1

(Base papers A–D): Hardwood bleached kraft pulp was beaten so as to give a fiber length of pulp of 0.56 mm as specified in this specification. Then, to 100 parts by weight of the pulp were added 3 parts by weight of cationized starch, 0.2 part by weight of anionized polyacrylamide, 0.4 part by weight of an alkyl ketene dimer (in terms of ketene dimer), 0.4 part by weight of polyamide epichlorohydrin resin, 1.5 part by weight of amphoteric polyacrylamide (molecular weight: 1,000,000), and suitable amounts of a fluorescent brightener, a blue dye, and a red dye to prepare a stock slurry. Then, this stock slurry was put on a Fourdrinier paper machine which ran at 200 m/min to form a web with giving a proper turbulence. The web was subjected to wet press of three stages adjusted to a linear pressure in the range of 15–100 kgf/cm at wet part, then, treated by a smoothing roll, and, at the subsequent dry part, subjected to smoothing press of two stages adjusted a linear pressure in the range of 30–70 kgf/cm, and then dried. Thereafter, in the course of drying, the web was subjected to size press with a 25 g/m$^2$ of a sizing solution comprising 4 parts by weight of carboxy-modified polyvinyl alcohol, 0.05 part by weight of a fluorescent brightener, 0.002 part by weight of a blue dye, 4 parts by weight of sodium chloride and 92 parts by weight of water, dried so that water content in the finally obtained base paper was 8% by weight in terms of an absolute dry water content, and then subjected to machine calendering so as to give a basis weight of 170 g/m$^2$, and a density of 1.02 g/cm$^3$, 1.05 g/cm$^3$, 1.07 g/cm$^3$, and 1.10 g/cm$^3$ to obtain base-paper A, base paper B, base paper C and base paper D as the supports for imaging materials, respectively.

(Base papers E–H): A stock slurry was prepared in the same manner as in preparation of the base paper A, except for using a hardwood bleached kraft pulp beaten so as to give a fiber length of pulp of 0.60 mm as specified in this specification. Thereafter, in the same manner as in preparation of the base paper A, except for using the resulting stock slurry, base paper E, base paper F, base paper G and base paper H were prepared by subjecting the web to machine calendering so as to give a basis weight of 170 g/m$^2$, and a density of 1.02 g/cm$^3$, 1.05 g/cm$^3$, 1.07 g/cm$^3$, and 1.10 g/cm$^3$, respectively.

(Base papers I–L): A stock slurry was prepared in the same manner as in preparation of the base paper A, except for using a hardwood bleached kraft pulp beaten so as to give a fiber length of pulp of 0.65 mm as specified in this specification. Thereafter, in the same manner as in preparation of the base paper A, except for using the resulting stock slurry, base paper I, base paper J, base paper K and base paper L were prepared by subjecting the web to machine calendering so as to give a basis weight of 170 g/m$^2$, and a density of 1.02 g/cm$^3$, 1.05 g/cm$^3$, 1.07 g/cm$^3$, and 1.10 g/cm$^3$, respectively.

Next, the side (back side) of each base paper opposite to the side on which an image forming layer is provided was subjected to corona discharge treatment. A compound resin composition was prepared by previously melt-mixing 65 parts by weight of a high-density polyethylene resin (density: 0.967 g/cm$^3$, MFR=10 g/10 min) and 35 parts by weight of a low-density polyethylene resin (density: 0.926 g/cm$^3$, MFR=0.6 g/10 min) using a melt-extrusion machine. This compound resin composition was melt-extrusion coated on the corona discharge treated back side of the base papers at a resin temperature of 315° C. and a resin thickness of 20 μm and under the four conditions of running speed of the base paper of 170 m/min, 200 m/min, 250 m/min and 315 m/min, thereby to form resin layer (B). In this case, a cooling roll roughened by a liquid honing method was used as the cooling roll, and the operation was conducted at a cooling water temperature of 12° C.

Successively, the top side of the base paper was subjected to corona discharge treatment. A resin composition which comprised 20 parts by weight of a master batch of titanium dioxide pigment comprising 47.5% by weight of a low-density polyethylene resin (density: 0.920 g/cm$^3$, MFR=8.5 g/10 min), 50% by weight of an anatase type titanium dioxide pigment surface-treated with hydrous aluminum hydroxide (0.75% by weight in terms of $Al_2O_3$ content based on titanium dioxide) and 2.5% by weight of zinc stearate, 65 parts by weight of a low-density polyethylene resin (density: 0.920 g/cm$^3$, MFR=4.5 g/10 min) and 15 parts by weight of a high-density polyethylene resin (density: 0.970 g/cm$^3$, MFR=7.0 g/10 min) was melt-extrusion coated on the top side of the base paper subjected to corona discharge treatment at a resin temperature of 315° C. and a resin thickness of 28 μm and under the same running speed of the base paper as in coating the resin layer (B). Thus, resin layer (A) was formed. The melt-extrusion coating of the polyethylene resin on the top side and the back side was carried out by so-called tandem method according to which sequential extrusion coating is carried out. In this case, the resin layer containing the titanium dioxide pigment of the resin-coated paper was processed to have a glossy surface.

Furthermore, during the period after processing of the top and back resin layers and before winding, the surface of the back resin layer of the resin-coated paper was subjected to corona discharge treatment and then coated on-machine with the following coating solution for a back layer. That is, a coating solution for back layer comprising colloidal silica and styrene latex at a dry weight ratio of 1:1 and, besides, containing 0.021 g/m$^2$ of sodium polystyrenesulfonate and a suitable amount of coating aid or the like was coated at a coating amount of 0.21 g/m$^2$ in terms of latex content (solid weight).

Furthermore, during the period after coating the back layer and before winding up the resin-coated paper, the surface of the resin layer on the top side was subjected to corona discharge treatment and, then, was uniformly coated on-machine, at a gelatin coating amount of 0.06 g/m$^2$, with a coating solution for subbing layer which contained 1.2 g of a lime-treated gelatin, 0.3 g of a low-molecular weight gelatin (P-3226 manufactured by Nitta Gelatin Co., Ltd.), 0.3 g of a 10 wt % methanolic solution of butyl p-oxybenzoate and 0.45 g of a 5 wt % mixed solution of sulfosuccunic acid-2-ethylhexyl ester in methanol and water and which was made up to 100 g in total with water. Thus, a support for imaging materials was obtained.

The performances of the resulting samples as a support for imaging materials were evaluated by the following methods.

The gloss appearance of photographic prints having the support for imaging materials was evaluated in the following manner.

A blue-sensitive emulsion layer containing a yellow coupler, an intermediate layer containing a color-mingling inhibitor, a green-sensitive emulsion layer containing a magenta coupler, an ultraviolet absorbing layer containing an ultraviolet absorber, a red-sensitive emulsion layer containing a cyan coupler, and a protective layer were coated, in succession, on the subbing layer of the support for imaging materials by E bar for multi-layer coating to prepare a color photographic paper having a total gelatin amount of 8 g/m$^2$. Each of the color-sensitive emulsion layers contained silver chlorobromide in an amount corresponding to 0.6 g/m$^2$ in terms of silver nitrate, and further contained a gelatin necessary for production, dispersion and film-formation of silver halide and, in addition, suitable amounts of an antiffogant, a sensitizing dye, a coating aid, a hardener, a thickening agent and a filter dye.

Then, the resulting color photographic paper was stored for 5 days at 35° C., and normal humidity, and, thereafter, a group picture was printed thereon, followed by subjecting to a processing comprising development, bleaching-fixing and stabilization, and then drying to prepare a photographic print. Separately, white solid print sample (unexposed) and black solid print sample (formation of black color) were also prepared. A series of the treatments of exposure, development and drying were carried out by an automatic printer and an automatic processor. The color development was carried out by the steps of procedure of color developing (45 seconds)→bleaching·fixing (45 seconds)→stabilizing (1.5 minute)→drying.

The thus obtained group picture, white solid and black solid photographic prints were visually and synthetically judged on glossiness by ten monitors and the results were evaluated by ten grades. The evaluation criteria are as follows (the larger grade value means the higher gloss appearance, and the smaller grade value means the lower gloss appearance):

Grades 11–12: Very high in gloss appearance.

Grades 10–9: Considerably high in gloss appearance.

Grades 8–7: High in gloss appearance.

Grades 6–5: Somewhat low in gloss appearance, but practically acceptable.

Grades 4–1: Low in gloss appearance to cause practical problems.

Next, curling properties of the support were evaluated by the following method. The state of curling of a photographic print of 8.2 cm×11.7 cm at 20° C., 40% RH was visually judged by ten monitors and evaluated by the following ten grades. The evaluation criteria are as follows (the higher grade value means the better curing properties, and the lower grade value means the worse curling properties):

Grade 10–9: The support curled somewhat in minus (i.e., curling with the back layer side being inward) or was flat, and curling properties were very good.

Grades 8–7: The support curled somewhat in plus (i.e., curling with the image forming layer side being inward), but curling properties were good.

Grades 6–5: The support curled in plus, but this was practically acceptable.

Grades 4–1: The support greatly curled in plus to cause practical problems.

Cutting properties of the support for imaging materials were evaluated in the following manner. The above color photographic paper of 8.2 cm in width in the form of roll was cut to a size of 11.7 cm in lengthwise direction by a precision print cutter set at 90 μm in edge width, and the state of the section was evaluated. The evaluation criteria of cutting properties are as follows (the higher grade value means the better cutting properties and the lower grade value means the worse cutting properties):

Grades 10–9: Cutting percentage by the cutter was 100% with formation of substantially no whiskers at the section, and the cutting properties were very good.

Grades 8–7: Cutting percentage by the cutter was 100% with only a slight formation of whiskers at the section, and the cutting properties were good.

Grades 6–5: Cutting percentage by the cutter was 100% with formation of whiskers at the section, but this was practically acceptable.

Grades 4–3: Cutting percentage by the cutter was 50–60%, and cutting percentage of 100% could not be attained unless the edge width was shortened by 10–15 μm to cause practical problems, or cutting percentage was 100%, but many whiskers were formed at the section to cause practical problems.

Grades 2–1: Cutting percentage by the cutter was 0% (namely, failure was 100%), and cutting percentage of 100% could not be attained unless the edge width was shortened by 20 μm or more, and even in this case, many whiskers were formed at the section to cause practical problems.

The results are shown in Table 1.

TABLE 1

| (Note 1) | Sample No. | Base paper of support | Fiber length of pulp (Note 2) | Density of base paper | Coating speed of resin layer (B) (m/min) | Visual glossiness (Note 3) | Curling properties (Note 4) | Cutting properties (Note 5) |
|---|---|---|---|---|---|---|---|---|
| | 1 | Base | 0.56 mm | 1.02 g/cm$^3$ | 170 | 4 | 4 | 10 |
| | 2 | paper A | | | 200 | 3 | 7 | 10 |
| | 3 | | | | 250 | 2 | 9 | 10 |
| | 4 | | | | 315 | 2 | 10 | 10 |
| | 5 | Base | 0.56 mm | 1.05 g/cm$^3$ | 170 | 9 | 3 | 10 |
| ○ | 6 | paper B | | | 200 | 9 | 6 | 10 |
| ○ | 7 | | | | 250 | 9 | 8 | 10 |
| ○ | 8 | | | | 315 | 9 | 10 | 10 |
| | 9 | Base | 0.56 mm | 1.07 g/cm$^3$ | 170 | 10 | 2 | 10 |
| ○ | 10 | paper C | | | 200 | 10 | 6 | 10 |
| ○ | 11 | | | | 250 | 10 | 8 | 10 |
| ○ | 12 | | | | 315 | 10 | 10 | 10 |
| | 13 | Base | 0.56 mm | 1.10 g/cm$^3$ | 170 | 10 | 2 | 10 |
| ○ | 14 | paper D | | | 200 | 11 | 5 | 10 |
| ○ | 15 | | | | 250 | 11 | 8 | 10 |
| ○ | 16 | | | | 315 | 11 | 10 | 10 |
| | 17 | Base | 0.60 mm | 1.02 g/cm$^3$ | 170 | 3 | 4 | 7 |
| | 18 | paper E | | | 200 | 3 | 7 | 6 |
| | 19 | | | | 250 | 2 | 8 | 6 |
| | 20 | | | | 315 | 1 | 10 | 6 |
| | 21 | Base | 0.60 mm | 1.05 g/cm$^3$ | 170 | 7 | 3 | 6 |
| ○ | 22 | paper F | | | 200 | 6 | 6 | 6 |
| ○ | 23 | | | | 250 | 6 | 8 | 6 |
| ○ | 24 | | | | 315 | 5 | 10 | 6 |
| | 25 | Base | 0.60 mm | 1.07 g/cm$^3$ | 170 | 8 | 2 | 6 |
| ○ | 26 | paper G | | | 200 | 8 | 6 | 6 |
| ○ | 27 | | | | 250 | 7 | 8 | 6 |
| ○ | 28 | | | | 315 | 7 | 10 | 6 |
| | 29 | Base | 0.60 mm | 1.10 g/cm$^3$ | 170 | 9 | 2 | 5 |
| ○ | 30 | paper H | | | 200 | 9 | 5 | 6 |
| ○ | 31 | | | | 250 | 9 | 8 | 6 |
| ○ | 32 | | | | 315 | 9 | 10 | 6 |
| | 33 | Base | 0.65 mm | 1.02 g/cm$^3$ | 170 | 3 | 4 | 3 |
| | 34 | paper I | | | 200 | 2 | 6 | 3 |
| | 35 | | | | 250 | 1 | 8 | 3 |
| | 36 | | | | 315 | 1 | 10 | 3 |
| | 37 | Base | 0.65 mm | 1.05 g/cm$^3$ | 170 | 3 | 3 | 3 |
| | 38 | paper J | | | 200 | 2 | 6 | 3 |
| | 39 | | | | 250 | 2 | 8 | 2 |
| | 40 | | | | 315 | 1 | 10 | 3 |
| | 41 | Base | 0.65 mm | 1.07 g/cm$^3$ | 170 | 4 | 2 | 2 |
| | 42 | paper K | | | 200 | 3 | 6 | 2 |
| | 43 | | | | 250 | 2 | 8 | 2 |
| | 44 | | | | 315 | 1 | 10 | 2 |
| | 45 | Base | 0.65 mm | 1.10 g/cm$^3$ | 170 | 3 | 2 | 1 |
| | 46 | paper L | | | 200 | 2 | 6 | 1 |
| | 47 | | | | 250 | 2 | 8 | 1 |
| | 48 | | | | 315 | 2 | 10 | 1 |

(Note 1) to (Note 5) in Table 1 are as follows:

(Note 1): "○" indicates the sample of the present invention.

(Note 2): Fiber length of pulp as measured by the method specified in this specification.

(Note 3): Gloss appearance as measured by the method specified in this specification.

(Note 4): Curing properties as measured by the method specified in this specification.

(Note 5): Curing properties as measured by the method specified in this specification.

From the results of Table 1, it can be seen that the supports for imaging materials according to the present invention (Sample Nos.6–8, Nos.10–12, Nos.14–16, Nos.22–24, Nos.26–28 and Nos.30–32) in which the fiber length of pulp of the base paper was 0.60 mm or less, the density of the base paper was 1.05 g/cm$^3$ or more, and coating speed of the resin paper (B) was 200 m/min or more were excellent supports for imaging materials which were good in gloss appearance, cutting properties and curling properties of the imaging materials. It can be seen that the fiber length of pulp is preferably 0.57 mm or less especially from the points of gloss appearance and cutting properties of the imaging materials, the density of the base paper is 1.07 g/cm$^3$ or more, more preferably 1.09 g/cm$^3$ or more from the point of gloss appearance, and furthermore the coating speed of the resin layer (B) is preferably 250 m/min or more, more preferably 315 m/min or more from the point of curling properties.

On the other hand, it can be seen that the supports for imaging materials which do not satisfy at least one of the conditions: length of pulp, density of base paper and coating speed of resin layer (B) and which are outside the scope of the present invention (Sample Nos.1–5, No.9, No.13, Nos.17–21, No.25, No.29 and Nos.33–48) were unsatisfactory in at least one of gloss appearance, cutting properties and curling properties.

EXAMPLE 2

Supports for imaging materials (Sample Nos.49 and 50) were prepared in the same manner as in preparation of Sample Nos.16 and 23 in Example 1, except that the resin layer (A) on the top side was formed by sequential extrusion molten resin coating method of two times at a thickness of 14 $\mu$m at each time and 28 $\mu$m in total. The resulting samples were evaluated on performances as a support for imaging materials in the same manner as above. As a result, Sample No.49 had the same performances as Sample No.16, except that the former showed a gloss appearance of grade 12 which was superior to the latter, and Sample No.50 had the same performances as Sample No.23, except that the former showed a gloss appearance of grade 8 which was superior to the latter, and thus these samples were excellent as supports for imaging materials. From the results, it can be seen that when the top resin layer comprising a thermoplastic resin is formed by sequential extrusion molten resin coating method of two or more times, the resulting support can provide imaging materials and prints of synergistically high gloss appearance, and this method is preferred.

EXAMPLE 3

Supports for imaging materials (Sample Nos.51 and 52) were prepared in the same manner as in preparation of Sample No.10 in Example 1, except that as the resin composition for forming the resin layer (B) on the back side, were used a compound resin composition prepared by previously melt-mixing 70 parts by weight of a high-density polyethylene resin (density: 0.967 g/cm$^3$, MFR=15 g/10 min) and 30 parts by weight of a low-density polyethylene resin (density: 0.924 g/cm$^3$, MFR=0.6 g/10 min) using a melt-extrusion machine, and a compound resin composition prepared by previously melt-mixing 78 parts by weight of a high-density polyethylene resin (density: 0.967 g/cm$^3$, MFR=10 g/10 min) and 22 parts by weight of a low-density polyethylene resin (density: 0.926 g/cm$^3$, MFR=0.6 g/10 min) using a melt-extrusion machine, respectively. The resulting samples were evaluated on performances as a support for imaging materials in the same manner as above. Furthermore, as for Sample No.10, Sample No.51 and Sample No.52, separately, those which had no back layer were also prepared for the purpose of measuring infrared dichroic ratio (value D) of the back resin layer, and the value D was measured by the method explained before. As a result, Sample No.10, Sample No.51 and Sample No.52 had a value D of 0.75, 0.63 and 0.57, respectively. Moreover, Sample No.51 and Sample No.52 showed the same performances as Sample No.10, except that the former samples had curling properties of grade 8 and grade 9 which were superior to those of the latter sample. Thus, these were excellent as supports for imaging properties. From the results, it can be clearly seen that the supports for imaging materials which have a value D of resin layer (B) of 0.70 or less are superior in curling properties and these are preferred.

EXAMPLE 4

Supports for imaging materials were prepared in the same manner as in preparation of Sample No.10 and Sample No.18 in Example 1, except that the resin layer (A) was formed by coating the top side with a compound resin composition comprising 80% by weight of a polypropylene (density: 0.920 g/cm$^3$, MFR=20 g/10 min), 5% by weight of a titanium dioxide pigment and 13% by weight of calcium carbonate at a resin temperature of 290° C. These supports for imaging materials were coated with the following ink jet image receiving layer in place of the multi-layer silver halide color photographic constituting layers used in Example 1, whereby ink jet imaging materials were prepared. When these imaging materials were printed by an ink jet printer, both the printed portions and non-printed portions showed good gloss appearance, and furthermore the curling properties and the cutting properties measured in the same manner as in Example 1 were also superior. Thus, they were excellent as supports for imaging materials.

The ink jet image receiving layer was formed by coating 7 g/cm$^2$ (solid content) of a coating solution which comprised 30 g of a 10 wt % aqueous gelatin solution of an alkali-treated gelatin having a molecular weight of 70,000, 37.5 g of a 8 wt % aqueous solution of sodium carboxymethylcellulose (etherification degree: 0.7–0.8; viscosity of 2 wt % aqueous solution measured by Brookfield type viscometer: 5 cp or less), 0.3 g of a 5 wt % methanolic solution of an epoxy compound (NER-010 manufactured by Nagase Sangyo Co., Ltd.), 0.5 g of a 5 wt % mixed solution of sulfosuccunic acid-2-ethylhexyl ester in methanol and water and 31.7 g of pure water.

The present invention provides an excellent resin-coated paper type support for imaging materials using a paper as a base which can provide imaging materials and prints made therefrom superior in visual gloss, cutting properties and curling properties.

What is claimed is:

1. A support for imaging materials which comprises a paper mainly composed of natural pulp as a base, a resin layer (A) comprising a resin having film-formability coated on one side of the paper base on which an image forming layer is provided and a resin layer (B) mainly composed of a polyethylene resin coated on another side of the paper base, wherein the natural pulp has a fiber length of pulp as defined below of 0.60 mm or less, the paper base has a density of 1.05 g/cm$^3$ or more, and the resin layer (B) mainly composed of a polyethylene resin is coated at 200 m/min or more, wherein said fiber length of pulp is determined by the following procedure:

immersing a paper base of 4 cm×4 cm of a support for imaging materials in 80 cm$^3$ of a 1.0 N aqueous sodium hydroxide solution for 3 days and then sufficiently washing with water, adding water to the paper base sufficiently washed with water so as to prepare a 3 wt % aqueous slurry, macerating said paper base by a dispersing apparatus not so as to cut the fibers to obtain a pulp slurry, and measuring the average fiber length of the pulp in accordance with JAPAN TAPPI Paper and Pulp Test Method No.52-89 "Paper and Pulp Fiber Length Test-Method".

2. A support for imaging materials according to claim 1, wherein the natural pulp has a fiber length of pulp of 0.57 mm or less.

3. A support for imaging materials according to claim 1, wherein the paper base has a density of 1.07 g/cm$^3$ or more.

4. A support for imaging materials according to claim 1, wherein the paper base has a density of 1.09 g/cm$^3$ or more.

5. A support for imaging materials according to claim 1, wherein the resin layer (B) mainly composed of a polyethylene resin is coated at 250 m/min or more.

6. A support for imaging materials according to claim 1, wherein the resin layer (B) mainly composed of a polyethylene resin is coated at 315 m/min or more.

7. A support for imaging materials according to claim 1, wherein the resin having film-formability in the resin layer (A) is a thermoplastic resin.

8. A support for imaging materials according to claim 7, wherein the thermoplastic resin of the resin layer (A) is coated by sequential extrusion molten resin coating method of two or more times.

9. A support for imaging materials according to claim 7, wherein the thermoplastic resin is a polyolefin resin.

10. A support for imaging materials according to claim 9, wherein the polyolefin resin is polyethylene resin.

11. A support for imaging materials according to claim 7, wherein the resin layer (A) and the resin layer (B) are sequentially and continuously coated on the base paper by extrusion molten resin coating method.

12. A support for imaging materials according to claim 1, wherein the resin layer (B) mainly composed of a polyethylene resin has an infrared dichroic ratio (value D) as defined below of 0.70 or less wherein the dichroic ratio (value D) Is determined by the following procedure:

peeling the resin layer (B) coated, without a back layer, on the side of the base paper opposite to the side on which the image forming layer is provided, from the base paper using an aqueous sodium hypochlorite solution, measuring an infrared absorption spectrum of this peeled film by an infrared ray polarized by a polarizing plate obtaining from the two infrared absorption peaks at about 720 cm−1 and about 730 cm−1 which result from rocking vibration of CH2 of polyethylene molecules, a peak intensity at about 720 cm−1 said peak intensity being a value of absorbance obtained using as a base line a line connecting a point of the smallest absorbance at 675–725 cm−1 and a point of the smallest absorbance at 725–775 cm−1, obtaining peak intensity A(=) at about 720 cm−1 of an infrared ray polarized in the direction parallel to the running direction (the longer direction) at melt-extrusion as a basic axis and a peak intensity A(+) at about 720 cm−1 of an infrared ray polarized in the direction perpendicular to the basic axis, wherein the ratio of A(=)/A(+) is the infrared dichroic ratio (value D).

13. A support for imaging materials according to claim 1, wherein the resin layer (A) contains a titanium dioxide pigment.

14. A support for imaging materials according to claim 1 which is for a silver halide photographic paper.

15. A support for imaging materials according to claim 1 which is for an ink jet recording material.

* * * * *